US005980160A

United States Patent [19]

Vanderklaauw

[11] Patent Number: 5,980,160

[45] Date of Patent: Nov. 9, 1999

[54] APPARATUS AND METHOD FOR A MODULAR LIFTING AND SHORING SYSTEM

[76] Inventor: Peter M. Vanderklaauw, 8360 SW. 186th St., Miami, Fla. 33157

[21] Appl. No.: 08/972,454

[22] Filed: Nov. 18, 1997

Related U.S. Application Data

[60] Provisional application No. 60/038,633, Feb. 19, 1997.

[51] Int. Cl.[6] ..... E02D 5/00

[52] U.S. Cl. ..... 405/230; 52/651.01; 52/651.15; 52/127.1; 182/178.1; 405/229; 405/288

[58] Field of Search ..... 405/229, 230, 405/196, 198, 199, 288; 52/592.6, 651.01, 651.05, 646, 127.1; 182/128, 187, 152, 178.1, 178.3, 178.5, 178.6; 254/93, 95, 98, 106

[56] References Cited

U.S. PATENT DOCUMENTS

| | | | |
|---|---|---|---|
| 1,279,901 | 9/1918 | Phelps | 405/230 X |
| 1,418,510 | 6/1922 | Alexander . | |
| 2,722,040 | 11/1955 | Ludowici . | |
| 2,742,260 | 4/1956 | Patterson | 52/651.15 X |
| 3,273,859 | 9/1966 | Walli . | |
| 3,347,002 | 10/1967 | Penkuhn | 405/230 X |
| 3,685,301 | 8/1972 | Heacox | 405/230 |
| 3,692,446 | 9/1972 | Vanderklaauw . | |
| 3,742,662 | 7/1973 | Ballou | 52/651.01 L X |
| 3,747,689 | 7/1973 | Frederick | 182/178.1 X |
| 3,828,513 | 8/1974 | Vanderklaauw . | |
| 3,831,902 | 8/1974 | Vanderklaauw . | |
| 3,920,780 | 11/1975 | Vanderklaauw . | |
| 4,011,705 | 3/1977 | Vanderklaauw . | |
| 4,067,448 | 1/1978 | Bergeron, Jr. . | |
| 4,070,867 | 1/1978 | Cassidy | 405/230 X |
| 4,206,162 | 6/1980 | Vanderklaauw . | |
| 4,251,974 | 2/1981 | Vanderklaauw . | |
| 4,262,773 | 4/1981 | Basham | 182/178.5 X |
| 4,634,319 | 1/1987 | May | 405/230 |
| 4,782,634 | 11/1988 | Fry . | |
| 4,832,315 | 5/1989 | Vanderklaauw . | |
| 4,964,761 | 10/1990 | Rossi . | |
| 4,980,999 | 1/1991 | Terenzoni . | |
| 5,004,375 | 4/1991 | Lee | 405/230 |
| 5,022,199 | 6/1991 | Horii et al. . | |
| 5,108,232 | 4/1992 | Strassil . | |
| 5,246,311 | 9/1993 | West et al. . | |
| 5,575,591 | 11/1996 | Vanderklaauw . | |

*Primary Examiner*—Dennis L. Taylor
*Attorney, Agent, or Firm*—Jones, Tullar & Cooper, P.C.

[57] ABSTRACT

The present invention provides a plurality of block-like building elements which may be bolted to each other to form a variety of support structures without the use of heavy hoisting equipment. Some of the building elements have a generally U-shaped appearance when viewed in plan, i.e., the building elements are open or slotted on one side so that a hydraulic cylinder or other lifting device may be inserted into the interior of the building element, or into a post formed from a stack of connected building elements. The lifting device may be used to preload the support structure. Advantageously, the lifting device may be used to progressively lift a load to a higher elevation by elevating the load a sufficient distance to enable the addition of an additional building element. The lifting device may then be repositioned within the structure for further elevating the load.

26 Claims, 13 Drawing Sheets

APPARATUS AND METHOD FOR A MODULAR LIFTING AND SHORING SYSTEM

CROSS-REFERENCE TO RELATED APPLICATION

This is a continuation-in-part of Ser. No. 60/038,633, filed on Feb. 19, 1997.

FIELD OF THE INVENTION

This invention relates generally to a modular support system which may be used in the construction and elevation of bridges, buildings, or other structures. In one aspect, this invention relates to a modular lifting and support system which includes a plurality of building elements and accessories which may be combined to raise or lower a structure from one elevation to another.

DESCRIPTION OF THE PRIOR ART

Temporary support systems for use in supporting structures under construction are normally referred to as falsework, shoring, or cribbing. Wood cribbing has been a tool for supporting and lifting heavy building elements since before the beginning of recorded history. The Egyptians used wood cribbing in the construction of their pyramids, and the Greeks used wood cribbing to jack up heavy stone lintels. Lifting force at those times was provided by lever booms, and sustaining support was provided by hardwood wedges. It was not until the late seventeen hundreds that mechanical screw jacks came into wide-spread use, replacing levers and pry bars. Hydraulic power came into practical application around the time of the American Civil War.

Today, conventional support systems are either made of large components, like scaffold sections, or they are custom-built from wood or steel. The scaffold approach is quite extensively used, and the scaffold materials are often reusable. However, scaffolds take up a large amount of space, and the load capacity and variety of applications are quite limited. The use of wood cribbing is labor intensive, and wood is limited as to weight capacity, useful height, and re-usability.

Furthermore, support structures are often designed for one specific project. A disadvantage of this is that these custom-built support structures take additional time to design and fabricate. This method also has the disadvantages of being expensive and wasteful of materials which often cannot be reused. Furthermore, conventional support systems do not normally include lifting devices, such as hydraulic jacks as an integral part of the system, making preloading of supports and elevating of a structure difficult. In particular, the prior art does not provide an economical means for efficiently raising a large structure from one elevation to another.

Thus, it is apparent that there is a need for a structural support system which provides the advantages of prior art cribbing, while eliminating the disadvantages, and while also providing additional features not available with prior art methods. The present invention sets forth a method and apparatus for such a support system.

SUMMARY OF THE INVENTION

Under the present invention, the support structures are constructed from a plurality of small generally similar block-like building elements or "cribs". The building elements may be bolted to each other to form posts. The building elements have a generally U-shaped appearance when viewed from top or bottom, i.e., the building elements are open or slotted on one side so that a hydraulic cylinder or other equipment may be inserted into the interior of the building elements, or into a post formed from a stack of connected building elements. With each individual building element weighing less than 40 pounds, the system of the present invention makes it easy to build a variety of support structures without the use of heavy lifting equipment.

Also in accordance with the present invention, hydraulic jacks may be used to preload the support system or to lift a load to a higher elevation. In most conventional support systems hydraulics are a special feature rather than an integral component. Furthermore, using conventional methods, lifting a large load to a higher elevation is generally not possible, or at least very difficult. However, with the present invention, special fixtures allow the installation of lifting devices on the building elements of the present invention, which makes it simple to preload the support system or lift a load, such as a roof or a building, to a higher elevation.

BRIEF DESCRIPTION OF THE DRAWINGS

FIG. 28 shows a pair of posts for lifting a bridge or the like.

DESCRIPTION OF THE PREFERRED EMBODIMENT

The present invention embodies a novel method and apparatus for lifting and shoring structures such as bridges, buildings, roofs, and the like. The present invention may also be used to meet a variety of heavy lifting requirements, such as in the lifting of machinery, buildings, bridges, roofs, or the like. The present invention employs a plurality of substantially similar building elements or "cribs". The building elements may be releasably connected to each other to form posts or beams. The ends of the building elements are preferably precision ground so that when a plurality of building elements are stacked and bolted together they form posts or beams which are perfectly straight and resistant to buckling.

Advantageously, hydraulic cylinders or other lifting devices are integrated with the building elements so that a load may be lifted or lowered from one elevation to another. A hydraulic cylinder may be incorporated within a post of assembled building elements to progressively add or remove building elements to or from the post, respectively. This is accomplished by extending the cylinder to lift a load, thereby creating a gap at the top, bottom, or along the length of the post. An additional building element may then be placed within the gap. The cylinder may then be moved up or down within the post, and the sequence repeated, so that the load is progressively raised or lowered. Under the preferred embodiment of the system of the present invention, a load of up to 25 tons may be lifted from as low as 13 inches of clearance to any practical height.

U.S. Pat. No. 5,575,591, entitled "Apparatus and Method for a Modular Support and Lifting System", to the same inventor as herein, sets forth an alternative system for shoring and lifting a load, and is incorporated herein by reference. This alternative system requires that a loading frame be used in most cases when elevating a load. The present invention eliminates the need for a loading frame, thereby also substantially reducing the starting height for lifting a load.

Figure 1:
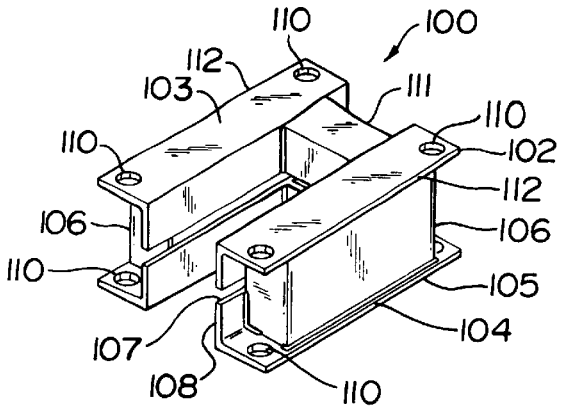
FIG. 1 shows a perspective view of a first embodiment of a building element of the present invention.
Figure 2:
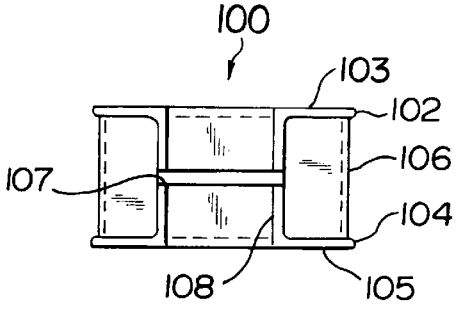
FIG. 2 shows a front view of the building element of FIG. 1.

FIGS. 1 and 2 show a block-like building element 100 for use with the present invention. Building element 100 includes an upper H-shaped mating member 102 and a generally identical lower H-shaped mating member 104. An opposed pair of C-shaped sections 106 connect upper mating member 102 to lower mating member 104. When assembled into a building element 100, upper mating member 102 forms an upper mating surface 103, while lower mating member 104 forms a lower mating surface 105, so that a plurality of building elements 100 may be connected to each other for forming elongate structures, as will be described below. In addition, C-shaped sections 106 are tall enough so that a gap 107 is formed between upper mating member 102 and lower mating member 104, the function of which gap 107 will be described below.

Figure 3:
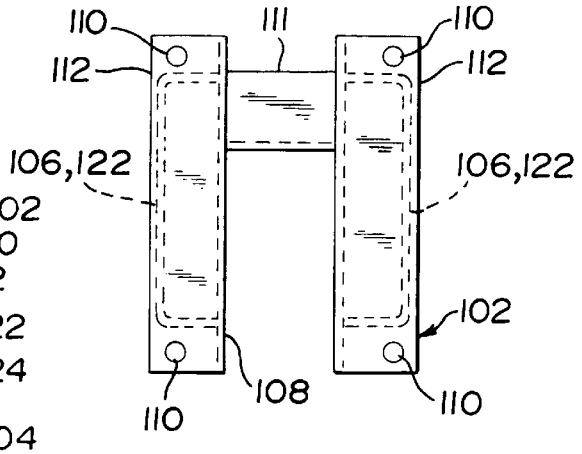
FIG. 3 shows a top view of the building elements of FIGS. 1 and 4.

As also illustrated in FIG. 3, mating members 102, 104 have an elongate, generally U-shaped, saddle opening 108 on one side to facilitate the insertion of a lifting device, such as a hydraulic cylinder, into the center of building element 100, as will be described in detail below. Mating members 102, 104 also include bolt holes 110 for releasably connecting one building element 100 to another by bolts (not shown) or other suitable fastening means.

As illustrated in FIG. 3, mating members 102, 104 are constructed from three pieces of angle welded together. A center angle 111 is welded transversely to two parallel side angles 112 to form a generally H-shaped mating member 102, 104. C-shaped sections 106 are then welded to either side of mating members 102, 104 for forming a complete building element 100. Following welding, the upper and lower respective mating surfaces 103, 105 of mating members 102, 104 are machined to be parallel so that when a plurality of building elements 100 are assembled to each other, the assembled building elements will form a straight elongate structural element.

It may also be noted that center angle 111 is offset with respect to the center of mating member 102, 104, when viewed in plan, as in FIG. 3. This leaves the center of building element 100 open for enabling a lifting device to be placed within the center of building element 100. Angles 111, 112 and C-shaped sections 106 are preferably formed of structural steel, although alternative materials may be used for particular applications. In the preferred embodiment, building element 100 is 10¾ inches long by 8½ inches wide by 4¾ inches high, and weighs approximately 28 pounds, so that building element 100 may be easily lifted and carried by a worker. Of course, alternative construction configurations may be used to form building element 100, so long as building element 100 has an upper mating surface, a lower mating surface, and an open side for allowing insertion of a lifting device.

Figure 4:
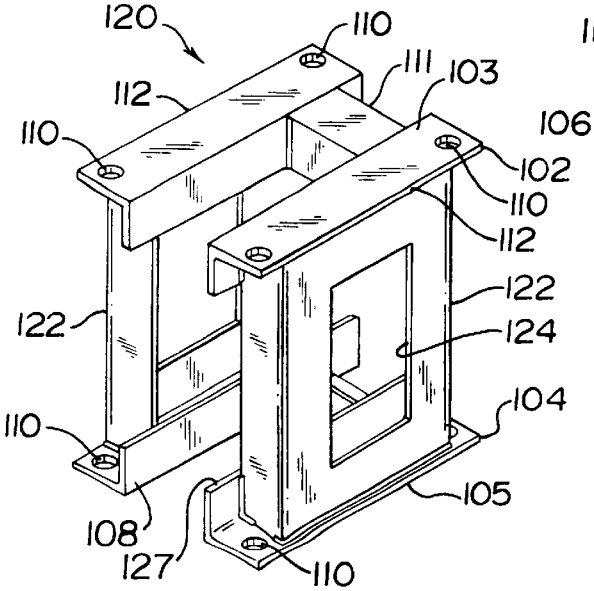
FIG. 4 shows a perspective view of a second embodiment of a building element of the present invention.
Figure 5A:
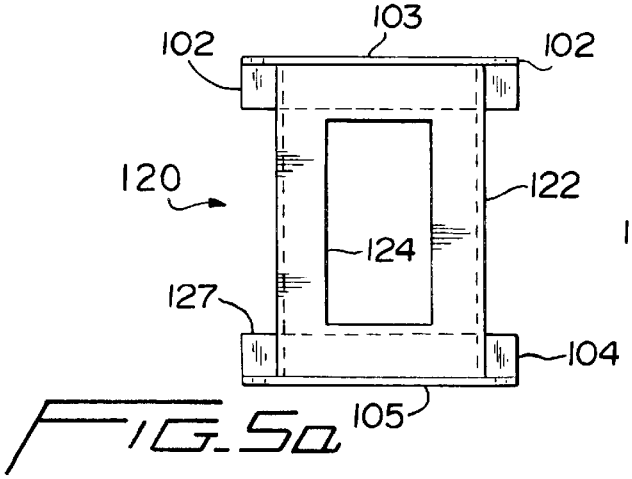
FIG. 5*a* shows a side view of the building element of FIG. 4.
Figure 5B:
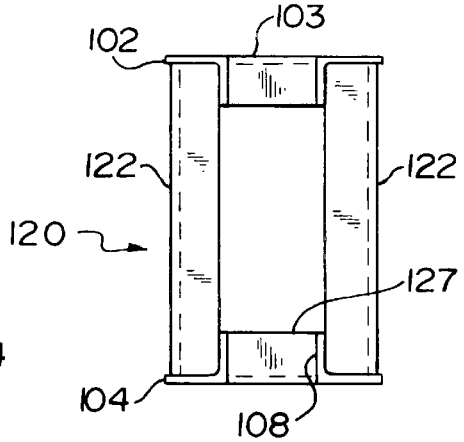
FIG. 5*b* shows a front view of the building element of FIG. 4.

FIGS. 4, 5*a* and 5*b* show a second embodiment 120 of a building element of the present invention. Building element 120 includes an upper mating member 102 and a lower mating member 104, as shown on building element 100, but building element 120 includes taller C-shaped sections 122. Taller C-shaped sections 122 may include lightening holes 124 for reducing the weight of building element 120. Building element 120 is generally identical to building element 100 when viewed from top or bottom, as shown in FIG. 3, and is of similar construction. In the preferred embodiment, building element 120 is 12 inches high, with the other dimensions being the same as in building element 100, and building element 120 weighs approximately 34 pounds. Of course, alternative heights for C-shaped section 122 may also be used. Accordingly, building element 120 has a substantially larger gap 127 than the gap 107 in building element 100. It may be seen that a building element 120 may be bolted to building elements 100 or to other building elements 120 for creating elongate structures, such as posts or beams.

Figure 6:
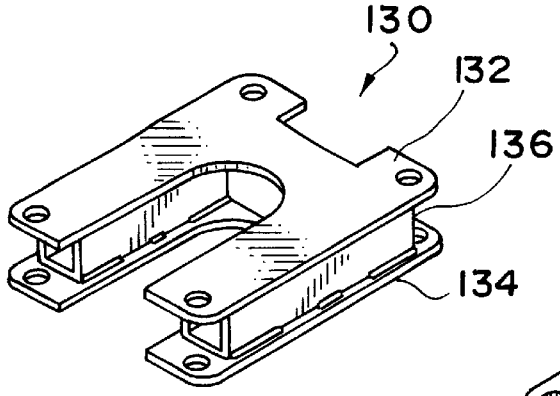
FIG. 6 shows a perspective view of a third embodiment of a building element of the present invention.

FIG. 6 shows a third embodiment of a building element 130 of the present invention. Building element 130 includes an upper mating plate 132 and a lower mating plate 134, which are of size and shape to match upper and lower mating members 102, 104 on building elements 100 and 120. However, building element 130 includes a shorter central U-shaped body 136 formed of square tubing. Building element 130 is preferably approximately 2 inches in height, and is primarily used as a filler block or fall-back block along with shims and wedges as will be described below. It may be seen that a building element 130 may be bolted to a building element 100, 120 or to other building elements 130 for creating elongate structures.

Figure 7:
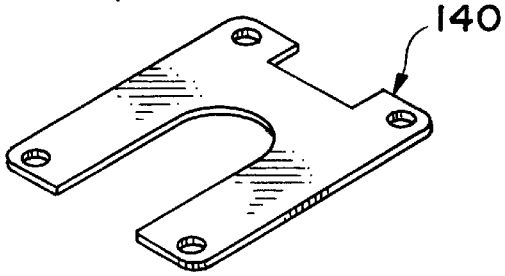
FIG. 7 shows a perspective view of a spacer plate.
Figure 8:
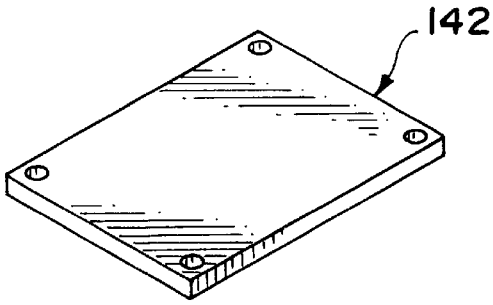
FIG. 8 shows a perspective view of a cap/base plate.

FIG. 7 shows a spacer plate 140 which may be used anywhere in a crib post to accommodated specific situations such a adjusting the distance between a building element mating surface and a load. FIG. 8 shows a cap/base plate 142 which is a rectangular steel plate ¾ inch thick. Cap/base plate 142 may be used at the top or bottom of a post of assembled building elements 100, 120, 130 for providing a bearing surface for wedges, shims, or the like, or for providing a bearing surface for a post.

Figure 9:
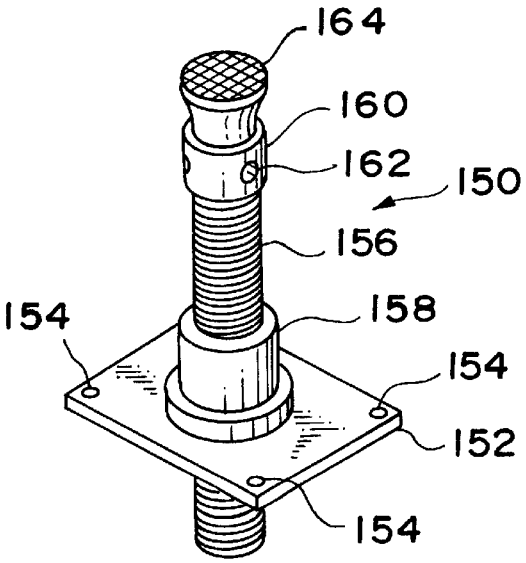
FIG. 9 shows a perspective view of a cap plate and screw jack combination.
Figure 10:
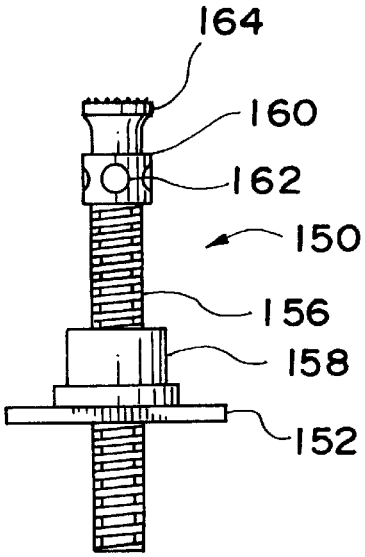
FIG. 10 shows a side view of the screw jack of FIG. 9.

FIGS. 9 and 10 show a screw-and-cap assembly 150 for mounting on top of a post of assembled building elements 100, 120, 130. Screw-and-cap assembly 150 includes a flange plate 152 which has bolt holes 154 located in a pattern which match upper mating surface 103 of building elements 100, 120, 130. A screw 156 fits within a threaded bushing 158 mounted on flange plate 152. The height of screw 156 may be adjusted vertically by turning. To facilitate turning of screw 156, a screw head 160 is included near the top of screw 156, and includes hole 162 for insertion of a lever bar (not shown). The lever bar may be inserted into hole 162 and used to turn screw 156 in the desired direction for raising or lowering screw 156. Located above screw head 160 is a cap 164 which bears against a load. Cap 164 is mounted for rotation of up to nine degrees on a chrome moly ball (not shown).

Figure 11:
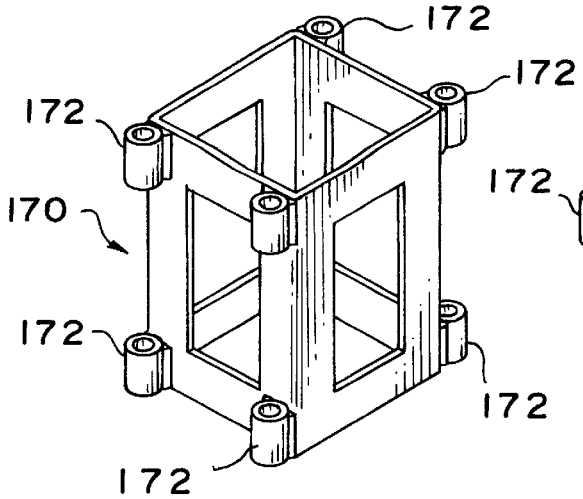
FIG. 11 shows a perspective view of a fourth embodiment of a building element.
Figure 12:
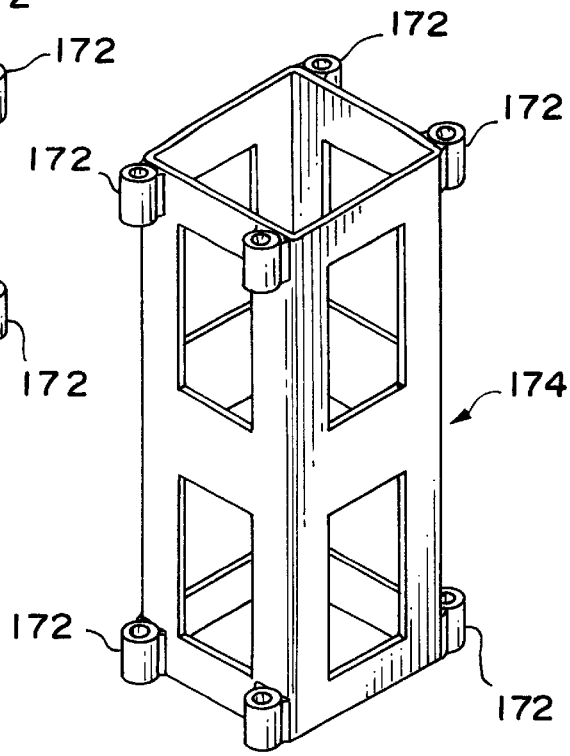
FIG. 12 shows a perspective view of a fifth embodiment of a building element.

FIGS. 11 and 12 show additional building elements which may be used in combination with building elements 100, 120, 130 and the other equipment described above. The construction and use of these building elements are described in the above-referenced U.S. Pat. No. 5,575,591 to the same inventor as the present application.

FIG. 11 shows a box building element 170 which includes a plurality of mating lugs 172 for enabling box building element 170 to be bolted to building elements 100, 120, 130, or other box building elements 170. FIG. 12 shows a box building element 174 which is similar to box building element 170 except that it is of greater height. The use of the box building elements 170, 174 in combination with building elements 100, 120, 130 increases the versatility of the system.

Figure 13:
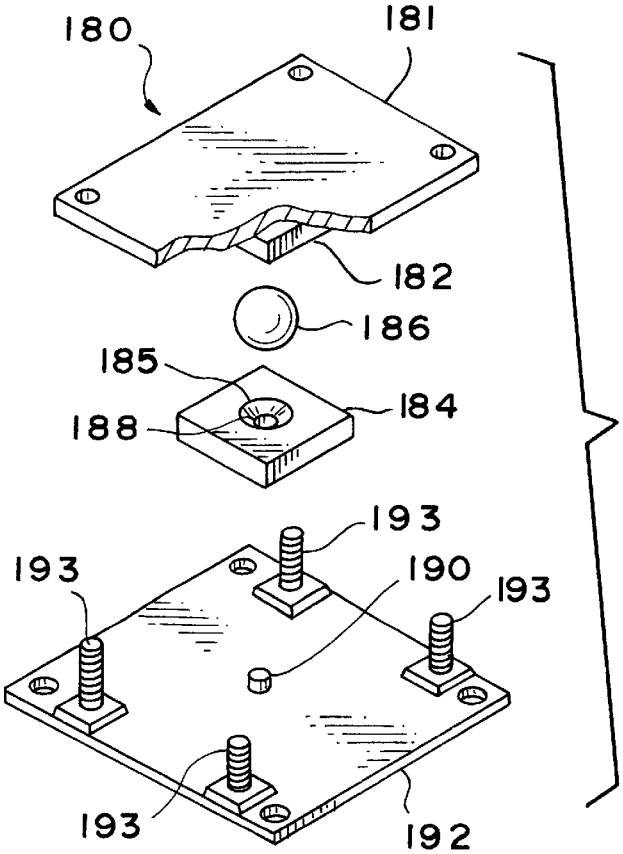
FIG. 13 shows an exploded view of a knuckle joint and base plate combination.

Posts constructed from building elements 100, 120, 130, 170, 174 may be mounted on several different base assemblies depending upon the underlying bearing surface. FIG. 13 shows a knuckle joint and base plate mounting combination 180. The knuckle joint and base plate combination 180 is advantageous because it provides a post with a self-centering ability that ensures concentric support, and enables a plumb post to be built on ground that is not level. A support plate 181 has a bolt pattern which matches that of building elements 100, 120, 130, 170, 174. Support plate 181 includes an upper knuckle plate 182 welded thereto. A matching lower knuckle plate 184 is assembled below upper knuckle plate 182, and both upper and lower knuckle plates include matching hemispherical indentations 185 for receiving a bearing ball 186. Lower knuckle plate 184 includes a locating hole 188 which passes through the center of lower plate 184. A locating pin 190 is fixed at the center of base plate 192, and locating pin 190 is inserted into locating hole 188 when lower knuckle plate 184 is assembled onto base plate 192. Four high strength studs 193 project upward from base plate 192. Studs 193 are configured in the same bolt pattern as building elements 100, 120, 130, 170, 174, and may be used to adjust a post of assembled building elements for plumbness when assembled as shown in FIG. 15*a*–15*c* by adjusting nuts 195.

Figure 14B:
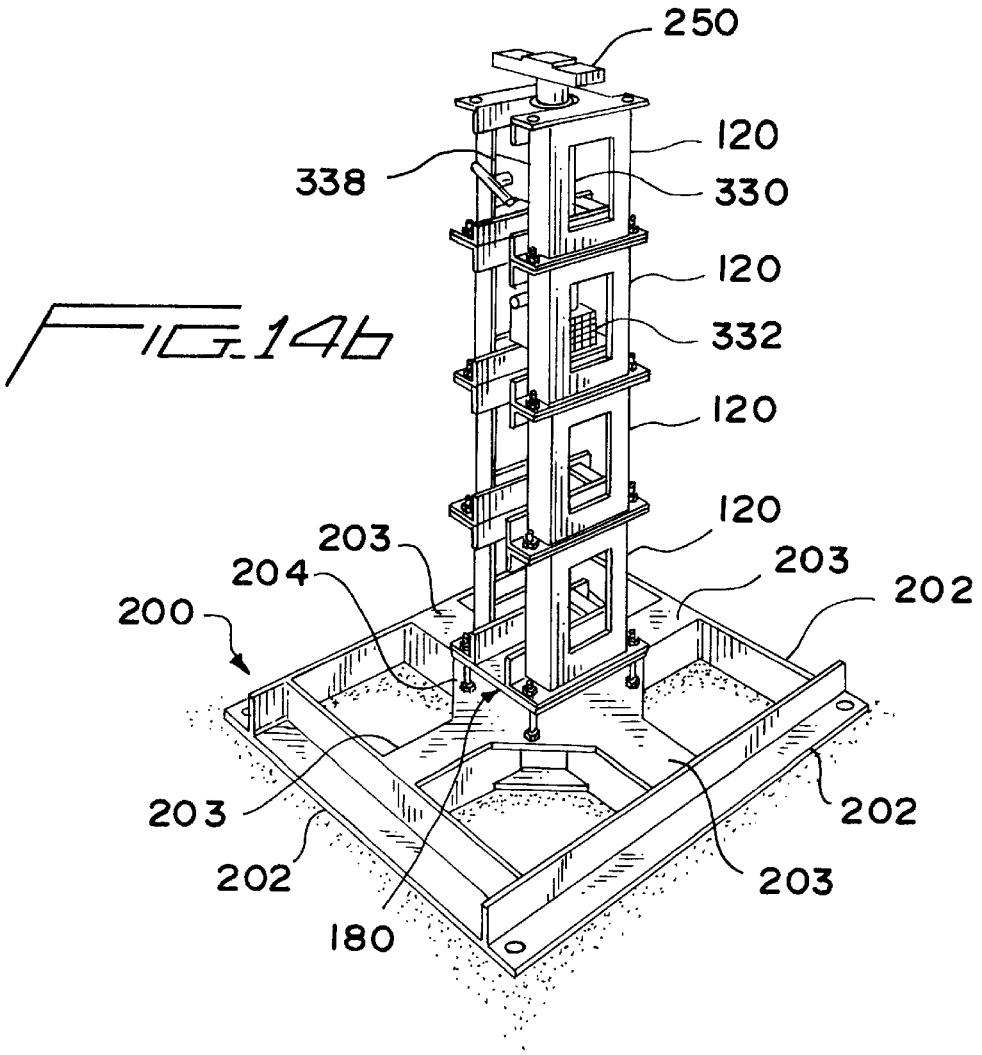
FIG. 14*b* shows the all-terrain base of FIG. 14*a* with a post mounted thereon.
Figure 14A:
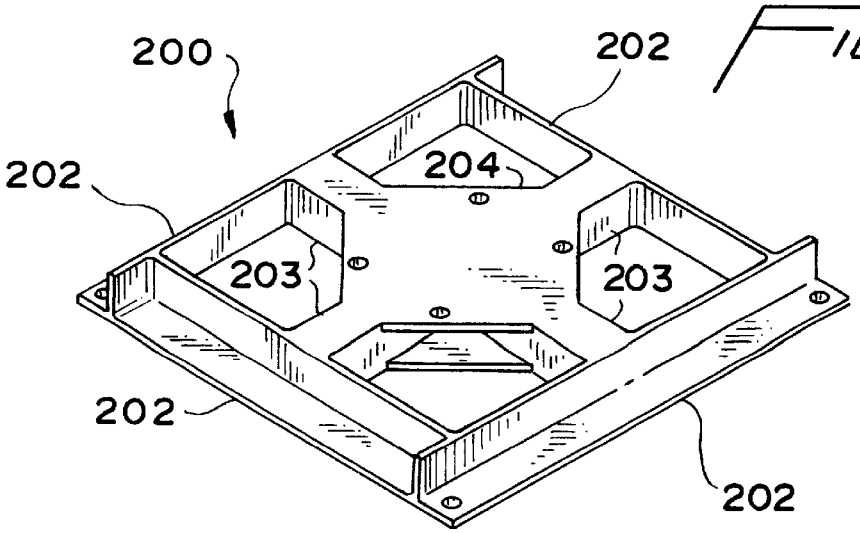
FIG. 14*a* shows an all-terrain base.
Figure 15A:
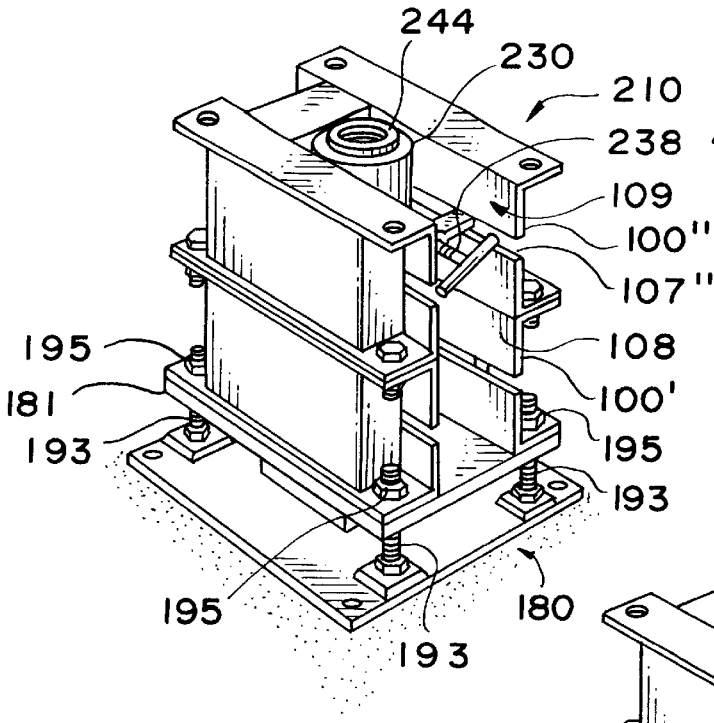
FIG. 15*a* shows a perspective view of a post constructed from a plurality of building elements.
Figure 15B:
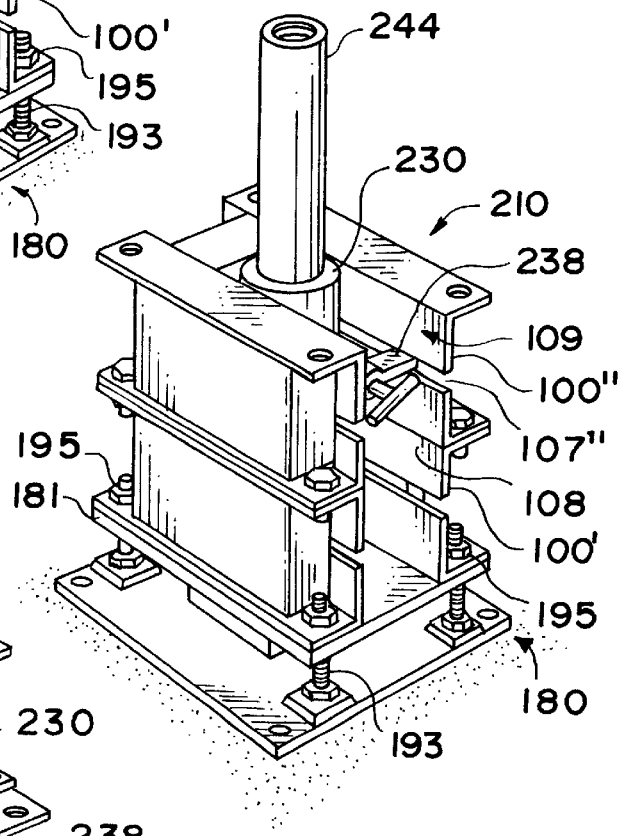
FIG. 15*b* shows the post of FIG. 15*a* with the cylinder ram extended.
Figure 15C:
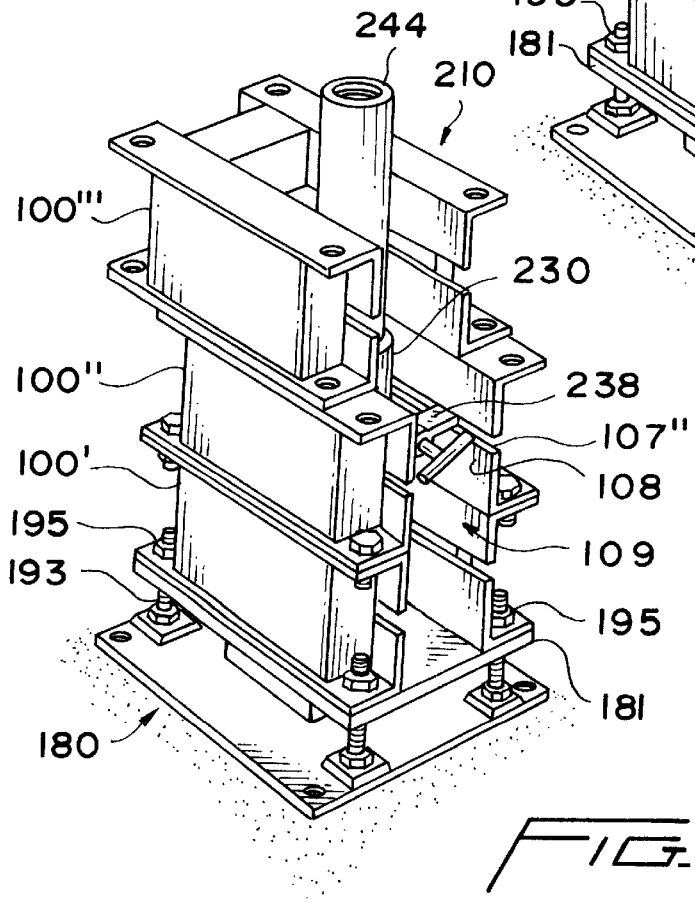
FIG. 15*c* shows the post of FIG. 15*a* to which an additional building element is being added.

The knuckle joint and base plate mounting combination is used when a post is to rest on a concrete surface, as shown in FIGS. 15*a*–*c*. If plumbness of a post is not a concern, as when the post will be relatively short in height, then the building elements may be mounted on a cap/base plate 142, or simply placed on the concrete surface. When the post of assembled building elements is to be located on a dirt or similar surface, an all-terrain base 200 is used, as shown in FIGS. 14*a* and 14*b*. All-terrain base 200 is constructed from four angle members 202, crossed box beam members 203, and includes a base plate 204 located at its center. Base plate 204 includes a bolt pattern for mounting building elements 100, 120, 130, 170, 174, and also may include a locating pin (not shown) to allow the use of the knuckle joint assembly 180 described above, with base plate 204 replacing base plate 192. FIG. 14*b* shows an all-terrain base 200 having a post constructed from building elements 120 mounted thereon in conjunction with a knuckle joint assembly 180.

Figure 16:
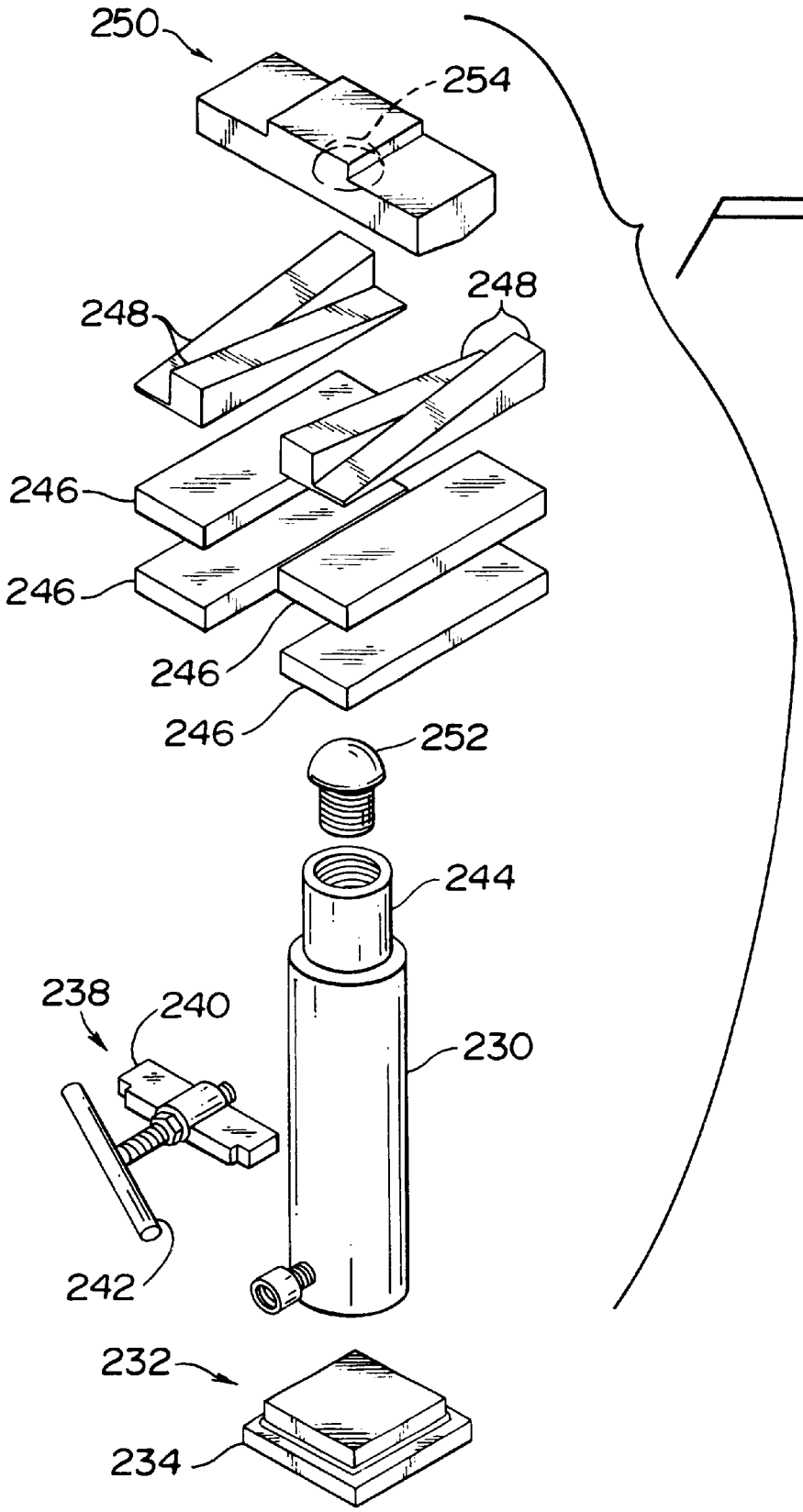
FIG. 16 shows an exploded view of lifting accessories for use with the building elements of the first embodiment of the present invention.

The basic method of operating the system of the present invention will now be described with reference to FIGS. 15*a*–15*c*. FIG. 15*a* shows an elongate structure or post 210 comprised of a first lower building element 100' bolted onto a knuckle joint and base plate combination 180. An upper second building element 100" is bolted to lower building element 100'. It may be seen that since building elements 100', 100" are open on one side, U-shaped openings 108 combine to form a slot 109 along one side of post 210. Located within slot 109 of post 210 is a lifting device such as a hydraulic cylinder 230, which is also illustrated in FIG. 16. Hydraulic cylinder 230 is preferably aligned with the major central axis of post 210 for supporting or lifting a load 233 (load illustrated in FIGS. 20*a*–20*c*; load not shown in FIGS. 15*a*–15*c* for clarity). Hydraulic cylinder 230 rests on base plate 181, or, if hydraulic cylinder 230 is to be installed at a location above base plate 181, hydraulic cylinder 230 is mounted on a shelf plate 232, as shown in FIG. 16. Shelf plate 232 has a flange 234 which enables shelf plate 232 to supported in gap 107 on a building element 100, as will be described in more detail below. Hydraulic cylinder 230 is preferably a standard 25 ton, 6 inch stroke hydraulic jack available from a variety of sources.

Figure 17:
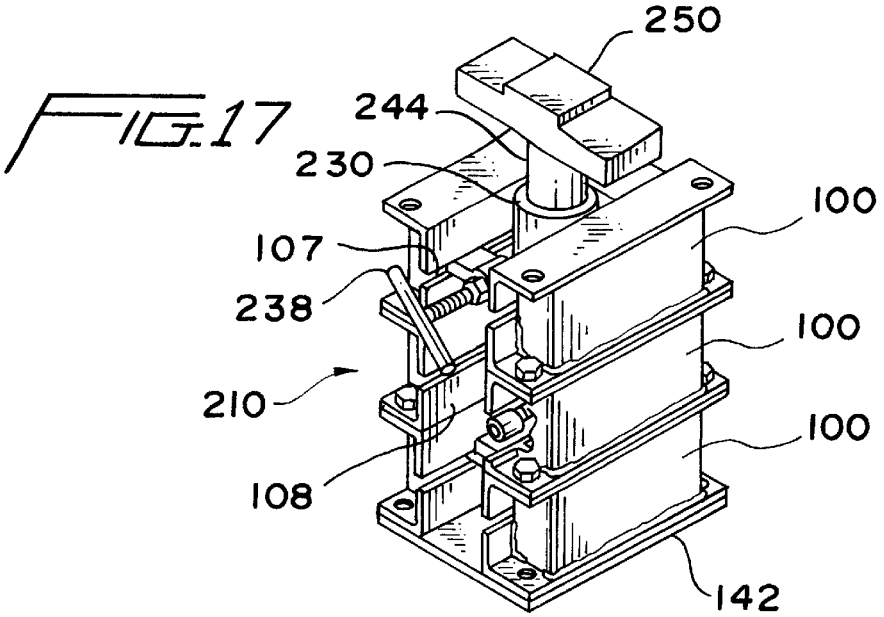
FIG. 17 shows a perspective view of a post having the lifting accessories of FIG. 16 installed.
Figure 18:
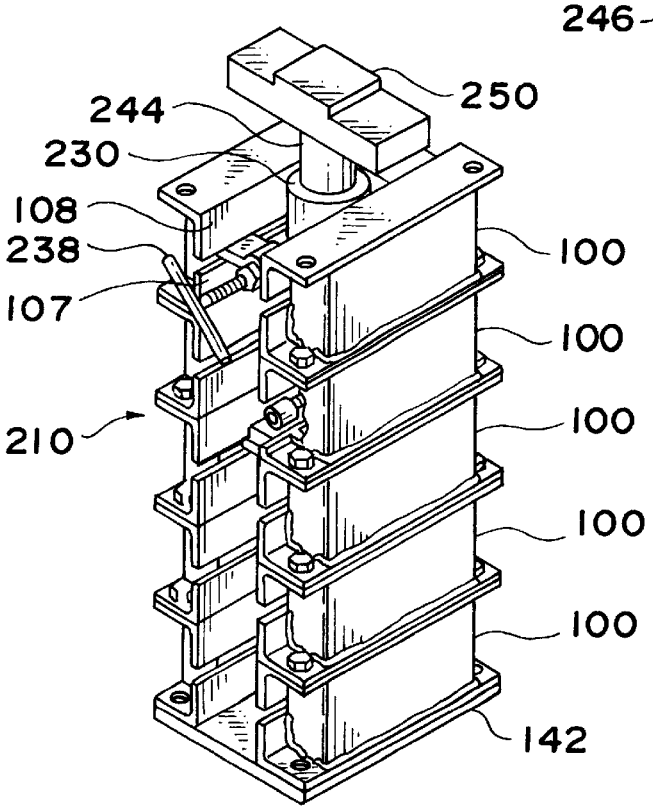
FIG. 18 shows a perspective view of the post of FIG. 17 following the addition of additional building elements.

A lateral support element 238, as also illustrated in FIG. 16 may be used to prevent lateral movement of cylinder 230. Lateral support element 238 includes a threaded plate 240 and thumb screw 242. Threaded plate 240 fits within gap 107" on building element 100", as also illustrated in FIGS. 17 and 18. Threaded plate 240 bears against C-shaped section 106 by spanning opening 108. Thumb screw 242 is tightened to press cylinder 230 against building elements 100', 100", so that cylinder 230 will not slip out of slot 109.

As illustrated in FIGS. 16–19, hydraulic cylinder 230 also may include a load transfer bar 250 mounted on the top of ram 244. As shown in FIG. 16, a ball cap 252 may be attached to the top of ram 244 by threads or other means. Ball cap 252 has a semi-spherical bearing surface, and a matching semi-spherical cup 254 is formed in the underside of load transfer bar 250 for receiving ball cap 252. Ball cap 252 and semi-spherical cup 254 help ensure that post 210 remains plumb despite angular variations between load 233 and post 210. Load transfer bar 250 also has a generally V-shaped underside when viewed in cross section from the end. The V-shaped underside facilitates the use of steel wedges 248 along with shims 246 during the lifting process, as is apparent from FIG. 19. In addition, load transfer bar 250 distributes the force of ram 244 on the load during lifting, and transfers the load from ram 244 to post 210 during the resetting mode.

Figure 19:
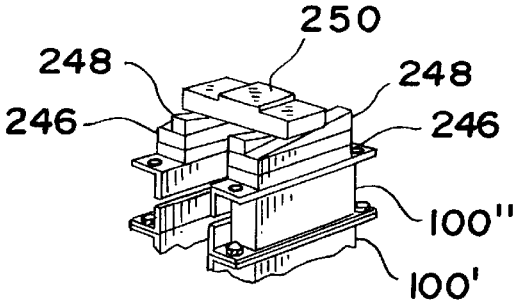
FIG. 19 shows the use of shims and wedges during the lifting cycle.

As illustrated in FIG. 15*a*, with cylinder 230 mounted within post 210, and with post 210 positioned beneath a load, hydraulic fluid under pressure may be delivered to cylinder 230 from a portable hydraulic pump or the like (not shown). This causes cylinder ram 244 to extend, as shown in FIG. 15*b*, thereby lifting the load a predetermined distance greater than the height of a building element 100. Because of the possibility of hydraulic failure, the gap between load 233 and the top of crib post 210 is filled temporarily with shims 246 and wedges 248, as shown in FIG. 19, or with shorter building elements 130. Once full extension of ram 244 is accomplished, a third building element 100'" may then be added to post 210, as shown in FIG. 15*c*.

Once third building element 100'" is bolted to upper building element 100", and shims 246 and/or wedges 248 added as desired to take up any additional gap between third building element 100'" and the load, the hydraulic pressure to cylinder 230 may be relieved, and the load allowed to rest on load transfer bar 250 or the top of post 210. Cylinder 230 may then be removed from crib post 210, and reinstalled one building element higher, as illustrated in FIGS. 20*a*–20*c*.

Figure 20C:
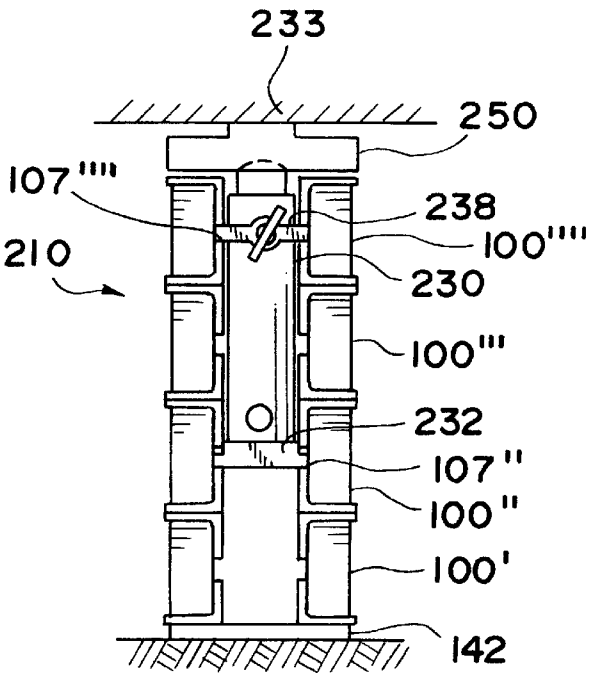
FIG. 20*c* shows the post of FIG. 20*b* following addition of an additional building element, with the lifting device repositioned.
Figure 20B:
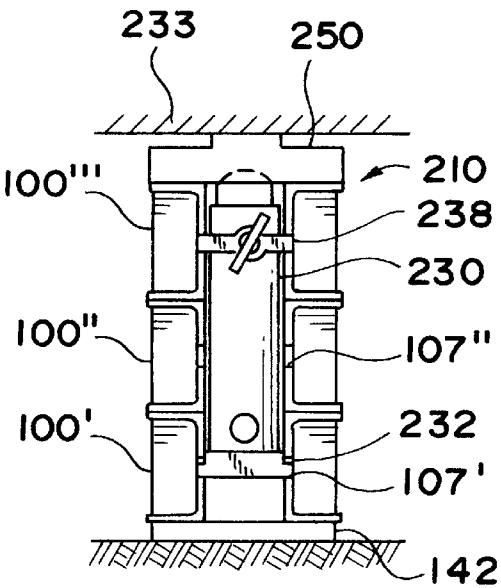
FIG. 20*b* shows the post of FIG. 20*a* following addition of an additional building element, with the lifting device repositioned.
Figure 20A:
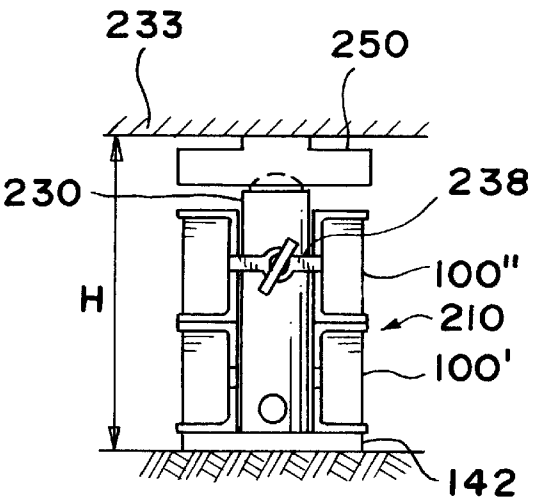
FIG. 20*a* shows a front view of a post having a lifting device installed therein.

In FIG. 20*a*, cylinder 230 is initially resting on a base plate 142 (the knuckle and base plate combination 180 is not shown in FIGS. 20*a*–20*c*). In FIG. 20*b*, a third building element 100'" has been added to post 210, by the method illustrated in FIGS. 15*a*–15*c*. Cylinder 230 has also been moved up, and is resting on shelf plate 232. Shelf plate 232 fits within gap 107' of building element 100'. It may be seen that shelf plate flange 234 fits within gap 107', so that shelf plate 232 can support cylinder 230. Thus, by using shelf plate 232, cylinder 230 may be placed in and supported by any building element 100 in post 210 if there is sufficient clearance from the top of the post. The maximum recommended unbraced height for a post 210 constructed from building elements 100 is 14 feet. However, if lateral bracing supports are incorporated, the maximum allowable height may be substantially greater.

In FIG. 20*c*, cylinder 230 has again been extended and a fourth building element 100"" has been placed on top of post 210. Shelf plate 232 is again moved up to gap 107" of second building element 100", and hydraulic cylinder 230 is placed within second, third and fourth building elements 100", 100'", and 100"". Lateral support element may then be installed into gap 107"" in fourth building element 100"", and the lifting step repeated to enable the placement of a fifth building element (not shown). In this manner, any number of building elements 100 may be added to post 210 for lifting a load to a desired height. It will be apparent that once load 233 has been lifted to a desired height, it may be supported at that height by a post 210 indefinitely, and then, if desired, lowered back to a lower level by reversing the above-described process.

It should be further noted that FIG. 20*a* illustrates the minimum height clearance H for which the system of the present invention is designed. In the preferred embodiment the minimum height H is 13 inches when post 210 is mounted on a base plate 142 (illustrated in FIGS. 20*a*–20*c*), and approximately 3 inches more when post 210 is mounted on a knuckle joint combination 180 (illustrated in FIGS. 15*a*–15*c*). Thus, a post 210 of the present invention may be constructed to lift a load of as much as 25 tons from a minimum height of 13 inches to practically any desired height.

Figures 21A, 21B, 21C, 21D:
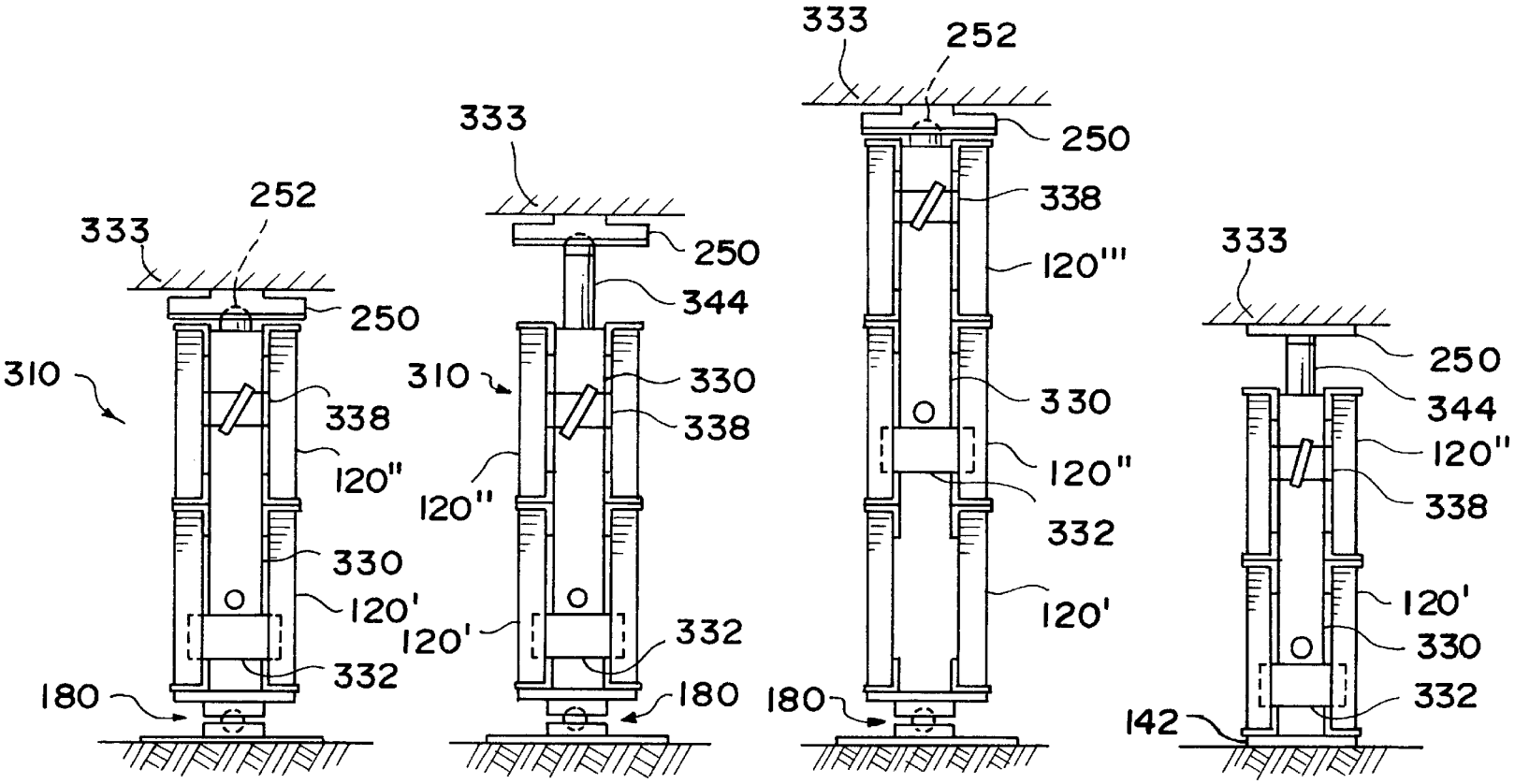
FIG. 21*a* shows a front view of a post constructed from building elements of the second embodiment, with a lifting device installed therein.
FIG. 21*b* shows the post of FIG. 21*a* with the load partially elevated.
FIG. 21*c* shows the post of FIG. 21*b* after full elevation of the load and the addition of an additional building element.
FIG. 21*d* shows the post of FIG. 21*a* mounted on a base plate.
Figure 25:
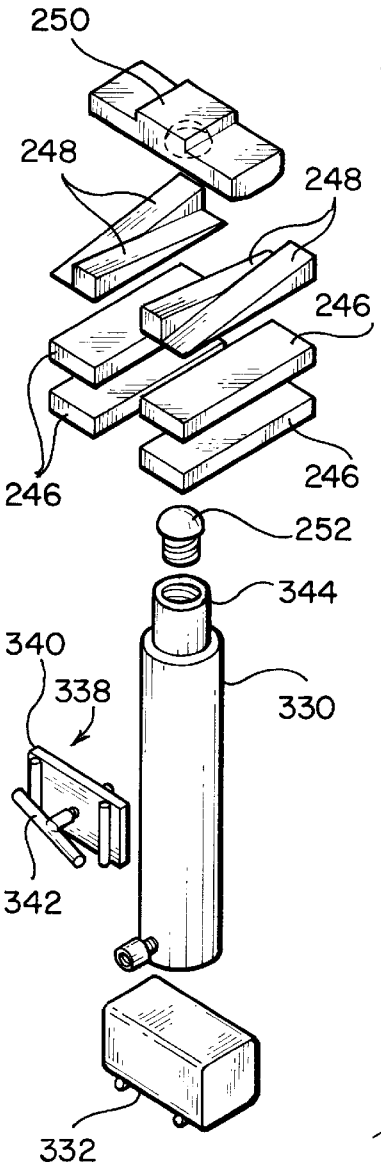
FIG. 25 shows an exploded view of lifting accessories for use with the building elements of the second embodiment.
Figure 22:
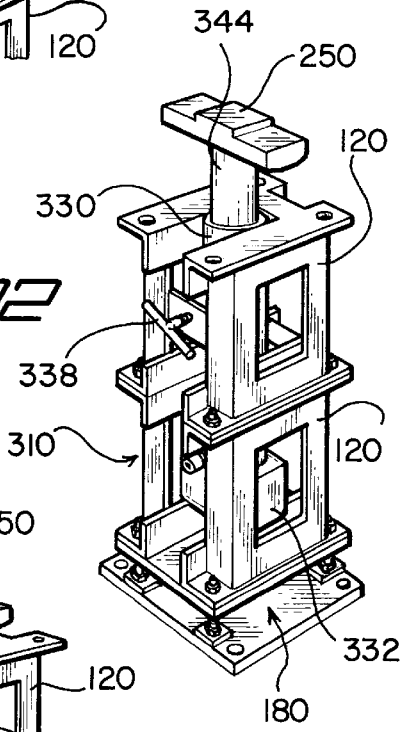
FIG. 22 shows a perspective view of the post of FIG. 21*a*.
Figure 23:
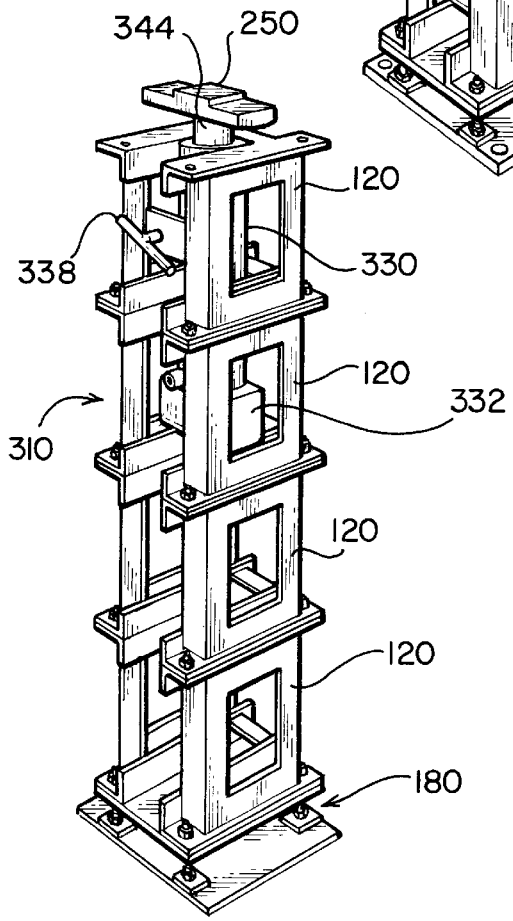
FIG. 23 shows the post of FIG. 22 following addition of additional building elements.

A similar post 310 may be constructed using building elements 120, as illustrated in FIGS. 21*a*–21*d* and 22–24. For post 310 constructed using building elements 120, a cylinder 330 having a longer, 14 inch stroke, as shown in FIG. 25 may be used. Cylinder 330 may be used with a shelf beam 332, as shown in FIGS. 22, 23, and 25 or with shelf plate 232. A lateral support element 338 may also be used with building elements 120. Lateral support element 338 is of similar construction and function as lateral support element 238 described above, but includes a larger threaded plate 340. Also, as is apparent from FIG. 24, a combination of building elements 100, 120 of different heights and wedges 248 or shims 246 may be used to provide support for a load at a desired height and to prevent fall-back following removal of hydraulic power.

Figure 24:
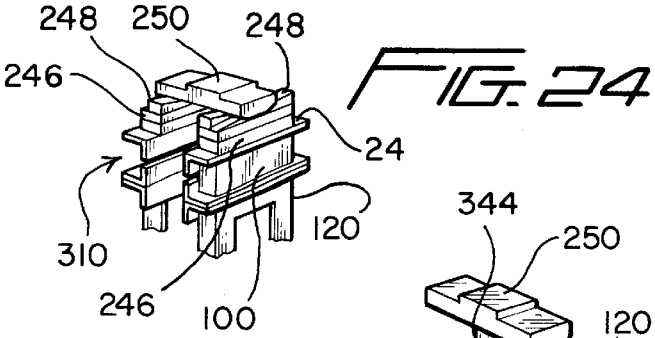
FIG. 24 shows the use of wedges and shims during the lifting of a load.

It may be seen from FIGS. 21*a*–21*c* that post 310 may be used to elevate a load 333 in a manner similar to post 210 described above. FIG. 21*a* shows post 310 prior to beginning the lifting process. FIG. 21*b* shows ram 344 partially extended as cylinder 330 is activated to elevate load 333. It is desirable that shims 246, wedges 248, or building elements 100, 130 be placed under load 333 at this point to protect against fall back, as shown in FIG. 24. Following full extension of cylinder 330, any shims 246, wedges 248, or building elements 100, 130 are removed, and an additional building element 120'" is placed on top of post 310 and bolted to building element 120". Cylinder 330, shelf member 332, and lateral support 338 may then be moved up one building element, to the position shown in FIG. 21*c*, and the lifting process may be repeated. FIG. 21*d* shows post 310 of FIG. 21*a* constructed on a base plate 142, rather than a knuckle joint and base plate combination 180.

It may be seen that the components of the present invention are interchangeable, and capable of meeting a variety of support and lifting needs. The system of the present invention may be used for simply lifting a piece of equipment, or may be used to lift an entire building. Through the use of cross supports, lateral bracing and other structural reinforcements set forth in the above-referenced U.S. Pat. No. 5,575,591, an almost limitless range of support and lifting structures may be built. Furthermore, when one project is complete, the parts may be used again in other projects where lifting and support requirements may be vastly different. Typical uses for the present invention include lifting (or lowering) a roof, a bridge, a house, a piece of machinery, or other heavy objects and structures.

All the parts of the present invention are sufficiently light in weight that they may be carried and installed by hand. Thus, hoists or other heavy lifting equipment are generally not required. All accessories, such as nuts, bolts, and hydraulic equipment are standard off-the-shelf parts, and may generally be obtained from local suppliers.

Using the system of the present invention, loads may be lifted to practically any height as long as sufficient lateral restraint is incorporated with the posts. Lowering a load is performed by reversing the lifting process, although controlled-rate snubber valves are recommended during lowering so that the rate at which the load drops is carefully controlled. In addition, during lifting using multiple posts at multiple points simultaneously, a lifting synchronization control system is recommended, as set forth in U.S. Pat. No. 4,832,315, to the same inventor as herein, and which is incorporated herein by reference. This synchronization system uses movable tapes and sensors for controlling the hydraulic pumps which supply fluid to the lifting cylinders. The synchronization system gives an exact indication of elevation, and enables an operator to monitor lifting at up to 48 or more points simultaneously at a single control station.

Figure 26:
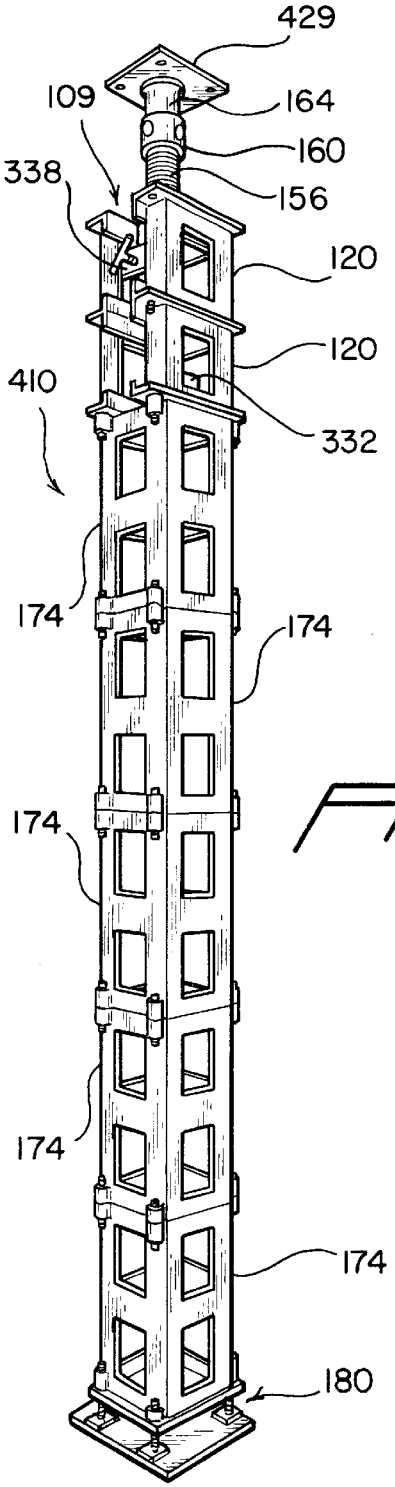
FIG. 26 shows a shore post constructed from building elements of the present invention.
Figure 27:
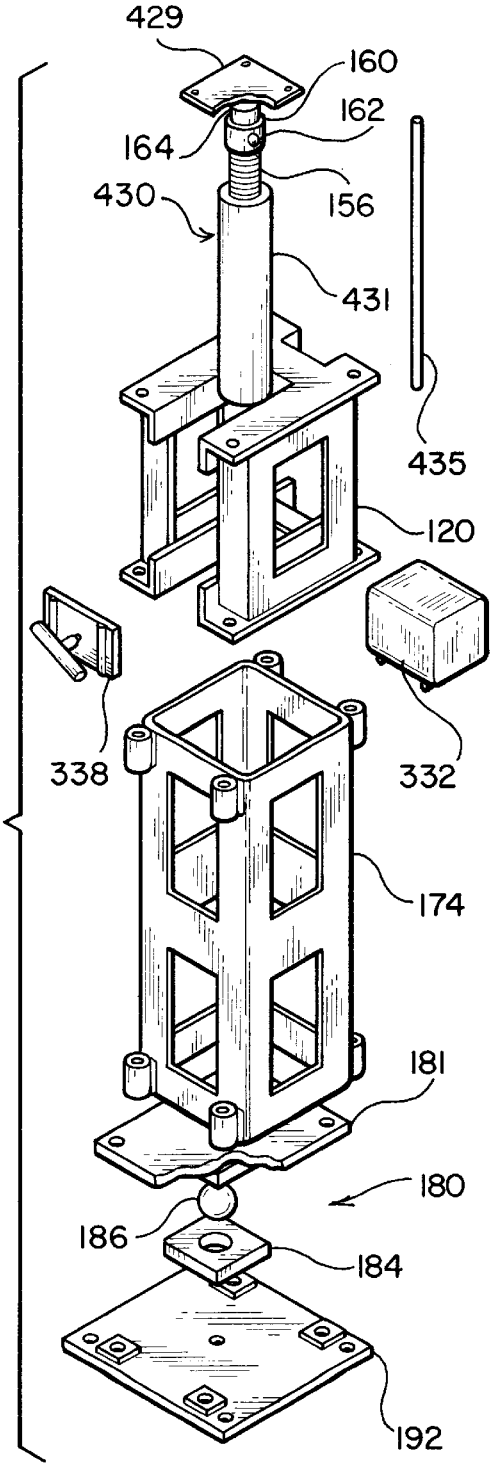
FIG. 27 shows the elements used in constructing the post of FIG. 26.

FIG. 26 shows use of the present invention for constructing a shoring post 410. The components used to construct shoring post 410 are set forth in FIG. 27, and it may be seen that post 410 is mounted on a knuckle joint and base plate combination 180, and includes a plurality of building elements 174, with at least two building elements 120 having openings 108 mounted on top thereof for forming a slot 109. A lifting device 430 is mounted within slot 109 of building elements 120 for preloading post 410. Lifting device 430 is preferably a screw jack similar to that described in FIGS. 9 and 10. However, as shown in FIG. 27, lifting device 430 is not mounted to a cap plate, but instead, includes a cylindrical body 431 having internal threads for receiving screw 156. A top plate 429 is attached to cap 164 by welding or the like. Lifting device is activated by turning screw 156 using lever bar 435. A load of up to 24 tons may be lifted in this manner. It is recommended that top plate 429 be bolted or welded to the load (not shown), because considerable side forces may be exerted on top plate 429 during turning of screw 156. These side forces could otherwise cause post 410 to slip from under the load.

It may be seen that lifting device 430 may be installed and used in a similar manner to lifting devices 230 and 330 described above. Thus, a load may be elevated, and an additional building element 120 may be placed on top of post 410. Lifting device 430, shelf beam 332, and lateral support 338 may then be moved up one building element 120, and the process repeated, as described above. Alternatively, of course, a hydraulic lifting device may be used, but hydraulics are not recommended for supporting a load for extended periods of time since a pressure failure could lead to collapse of the lifting device, and consequent dropping of the load.

Figure 28:
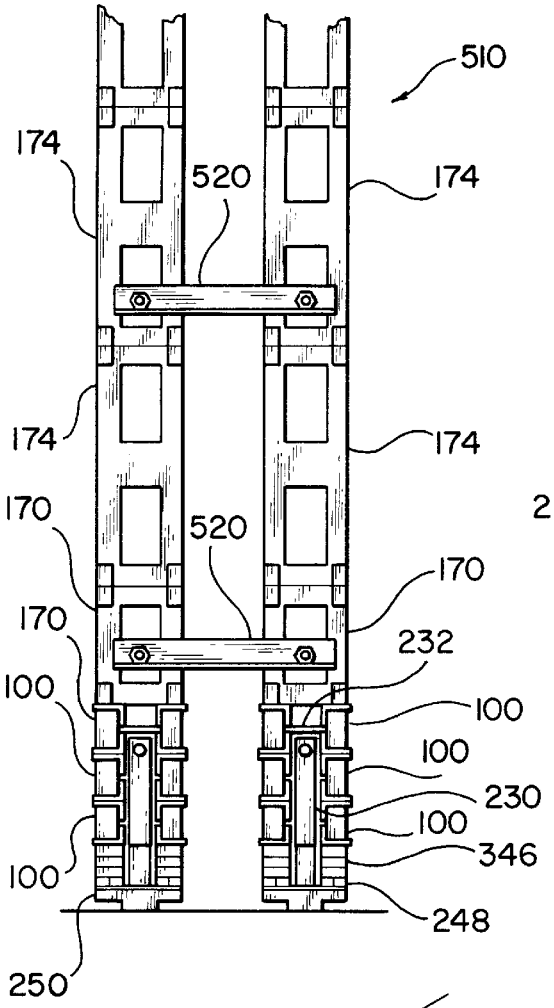
Figure 29:
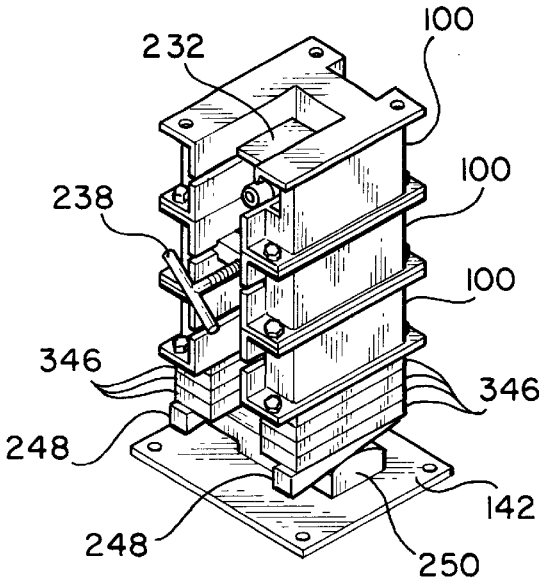
FIG. 29 shows a perspective detail of the lower portion of the post of FIG. 28.
Figure 30:
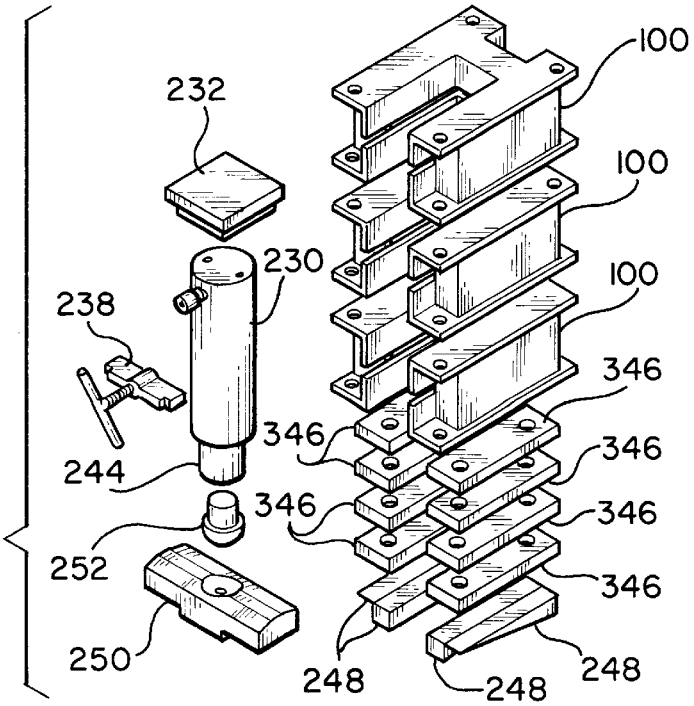
FIG. 30 shows and exploded view of the post of FIG. 29.

FIG. 28 shows a pair of posts 510 which may be used for elevating heavy structures, such as bridges or the like. Each post 510 is constructed from a plurality of building elements 174, 170, as shown, and includes a plurality of building elements 100 at the base for facilitating lifting. Lateral bracing supports 520 are included for connecting one post 510 to the other post 510. In this manner the safe maximum height of the posts may be increased. The lifting accessories located in the plurality of building elements 100 at the bottom of posts 510 are configured upside down in comparison to the previous examples. As also illustrated in FIGS. 29 and 30, shelf plate 232, cylinder 230, and load plate 250 are all configured to enable extension of ram 244 toward the ground. It may be seen that as ram 244 is extended, not only the load, but the entire post 510 is lifted. An additional building element 100 may then be placed on the bottom of post 510, and the process repeated for progressively elevating the load and post 510.

Advantageously, magnetic shims 346 are provided for use with this configuration. Magnetic shims 346 adhere to the bottom of the bottom-most building element 100, for facilitating insertion of shims 346 and wedges 248 during the lifting process to protect against fall-back in case of hydraulic failure.

Figures 31, 32, 33:
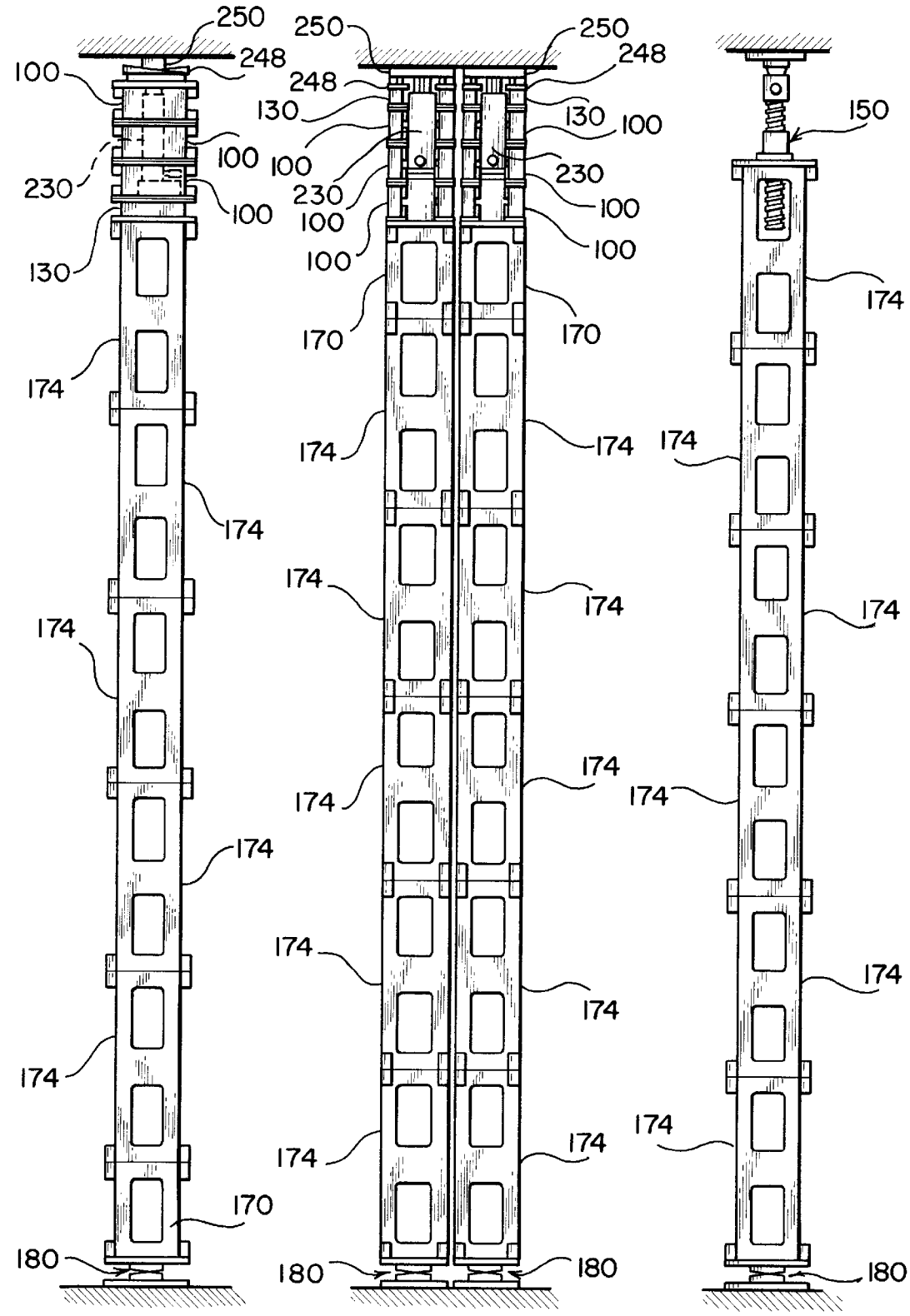
FIG. 31 shows an alternative example of a structure constructed from building elements of the present invention.
FIG. 32 shows an alternative example of a structure constructed from building elements of the present invention.
FIG. 33 shows an alternative example of a structure constructed from building elements of the present invention.

FIGS. 31–33 demonstrate how the various combinations of the above described components may be employed for additional desired uses. FIGS. 31 and 32 show posts which may be used for purposes similar to post 510 shown in FIG. 28, with the exception that building elements are added at the top of the posts instead of at the bottom. FIG. 33 demonstrate how the screw and cap assembly 150 may be placed at the top of a post to be used for preloading a post when a post is being used as a shore. In light of the foregoing discussion, these structures are believed to require no further explanation. Of course, other combinations that will be apparent to one skilled in the art.

Thus, the present invention has a number of advantages over the prior art. The system provides an apparatus and method for constructing elongate post structures for shoring and lifting. The plumbness of the posts may be accurately controlled by adjusting the nuts 195 on studs 193 at the knuckle joint base. The system allows braces to be installed, thus permitting the load to be lifted to any desired height. The building elements are dimensionally stable, with no uncontrolled movement due to swelling or shrinking. The building elements may be pre-tested to ensure that they are safe to use. The posts have small foot prints and can be used in confined areas. When properly maintained, the building elements can be used over and over for different jobs. The building elements are light enough that a single person can lift them, eliminating the need for hoisting equipment for beams or the like.

While preferred embodiments of a method and apparatus for a modular support and lifting system in accordance with the present invention have been set forth fully and completely hereinabove, it will be apparent to one of skill in the art that a number of changes in, for example, the sizes and shapes of the various components, the materials used, the configurations constructed, and the like can be made without departing from the true spirit and scope of the present invention, which is to be limited only by the following claims.

What is claimed is:

1. An apparatus for a modular system for supporting and lifting loads, said apparatus comprising:

a plurality of releasably connectable building elements, each said building element having a first mating end, a second mating end, and a plurality of sides therebetween, for forming a generally block-shaped building element, each said building element further being open on one of said sides and on said first and second mating ends to form a open slot-like center, said first mating end and said second mating end further being configured to releasably mate with other said first or second mating ends of other of said building elements whereby a plurality of said building elements may be releasably and securely connected to each other for forming an elongate structure having an open slot formed along its length;

an elongate structure formed by connecting a plurality of said building elements, said elongate structure having an open slot along one side of its length; and a shelf member removably mountable within any of said building elements within said open slot for supporting the load of a lifting device within said open slot, said building elements being configured for receiving and supporting said shelf member.

2. The apparatus of claim 1 further including a lifting device in contact with said shelf member, whereby said lifting device may be located at a plurality of desired locations within said elongate structure by placing said shelf member in one of said building elements and placing said lifting device within said slot to bear against said shelf member.

3. The apparatus of claim 1 wherein said first mating end and said second mating end of said building elements are constructed as generally identical H-shaped members, and said sides include a pair of opposed C-shaped sections connecting said H-shaped members.

4. The apparatus of claim 2 wherein said lifting device is located upside down within said slot for lifting both the load and the elongate structure.

5. The apparatus of claim 1 further including a gap located within said sides between said first mating end and said second mating end, said gap being sized for receiving said shelf member for supporting the load of a lifting device within said elongate structure.

6. An apparatus for progressively lifting or lowering a load, said apparatus comprising:

an elongate structure having an open slot along one side of its length, said elongate structure being formed from a plurality of connectable building elements, each said building element having a first mating end, a second mating end, and a plurality of sides, for forming a generally block-shaped building element, each said building element further being open on one of said sides and on said first and second mating ends to form a open slot-like center, said first mating end and said second mating end further being configured to releasably mate with other said first or second mating ends of other of said building elements whereby a first building element may be releasably securely connected to a second building element for forming an elongate structure having an open slot along one side of its length;

a lifting device for placement within said open slot; and a shelf member removably mountable within said open slot for supporting the load of said lifting device, each said building element being configured for receiving and supporting said shelf member;

whereby when a plurality of said building elements are connected to each other for forming said elongate structure, said shelf member and said lifting device may be placed at a plurality of locations within said elongate structure such that said lifting device may be activated to progressively lift a load to enable additional said building elements to be added to said elongate structure or said lifting device may be activated to progressively remove said building elements from said elongate structure for lowering the load.

7. The apparatus of claim 6 further including a gap located within said sides of said building elements between said upper mating end and said lower mating end, said gap being sized for receiving said shelf member so that said sides support said shelf member.

8. The apparatus of claim 6 further including a lateral support element placeable within said slot for securing said lifting device within said slot.

9. The apparatus of claim 6 further including a knuckle joint and base plate combination for connection to one of said building elements for location one end of said elongate structure whereby said knuckle joint and baseplate combination enable said elongate structure to be adjusted for plumbness;

said knuckle joint and base plate combination including an upper plate for connection to one of said first or second mating surfaces of said building elements, a lower plate, and a bearing ball located between said upper plate and said lower plate.

10. An apparatus for shoring or elevating a load, said apparatus comprising:

an elongate structure constructed from a plurality of block-like building elements releasably connectable to each other for forming said elongate structure, each said building element having a first mating surface, a second mating surface located opposite to said first mating surface, and four non-mating sides located between said first mating surface and said second mating surface, with one of said sides on each said building element being open, and with said first and second mating surfaces each having a generally U-shaped opening aligned with said open side, so that when a plurality of said building elements are connected to each other to form said elongate structure, said openings form a slot extending along the length of said elongate structure to enable placement of a lifting device at a plurality of locations within said elongate structure;

a shelf member configured to be placed in any of said building elements for supporting the load of a lifting device, said building elements being configured to receive and support said shelf member; and a lifting device in contact with said shelf member within said slot.

11. The apparatus of claim 10 further including at least one generally box-shaped building element, said box-shaped building element having a first mating surface, a second mating surface and four non-mating sides, said box-shaped building element being connectable to either end of said elongate structure for increasing the length thereof.

12. The apparatus of claim 10 further including a lateral support element placeable within said slot for securing said lifting device within said slot.

13. A method for moving a load away from a support surface, said method comprising:

providing a plurality of releasably connectable block-like building elements, said building elements having a first mating end, a second mating end, and three non-mating sides, with a fourth non-mating side being open for receiving a lifting device;

securely connecting a plurality of said building elements to each other for forming a rigid elongate structure such that said open sides are aligned for forming a slot along at least a portion of said elongate structure, said elongate structure being positioned between the load and the support surface;

positioning a lifting device within said slot, said lifting device being in structural communication with either the load or the support surface and also being fixed within said slot; and activating said lifting device to move the load away from the support surface.

14. The method of claim 13 further including the step of adding an additional said building element to said elongate structure following the movement of the load away from the support surface.

15. The method of claim 14 further including the step of deactivating said lifting device to allow said load or said support surface to contact said elongate structure.

16. The method of claim 15 further including the step of repositioning said lifting device within said slot of said elongate structure toward said additional building element, and activating said lifting device for further moving the load away from the support surface.

17. The method of claim 13 further including the step of positioning the lifting device within said slot in structural communication with the support surface so that when said lifting device is activated, said lifting device moves both the load and the elongate structure away from the support surface.

18. A method of progressively elevating a load, said method comprising:

forming an elongate post by connecting a plurality of releasably connectable building elements, each said building element having an upper mating end, a lower mating end, and four non-mating sides for forming a generally block-shaped building element, each said building element further being open on one of said sides and on said first and second mating ends to form an open slot along the length of said post, positioning said post under the load to be elevated;

fixing a lifting device within said open slot of said post so that said lifting device is able to elevate the load;

activating said lifting device to elevate the load a sufficient distance to enable the addition of an additional building element to said post;

deactivating said lifting device for lowering said load into contact with the upper end of said post; and repositioning said lifting device to a location within said open slot closer to the load to further elevate the load, whereby the load is progressively elevated.

19. The method of claim 18 further including the step of providing at least one generally box-shaped building element, said box-shaped building element having a first mating surface, a second mating surface and four non-mating sides, and mounting said post on said box-shaped building element during construction of said post.

20. The method of claim 18 further including the step of providing a shelf member for fixing the location of said lifting device within said open slot at any of a plurality of locations.

21. The method of claim 18 further including the steps of providing a plurality of said posts and connecting at least some of said posts to each other by bracing supports, each said post containing a lifting device.

22. The method of claim 21 further including the step of simultaneously activating the lifting devices in said connected posts.

23. The method of claim 18 further including the step of progressively lowering the load by reversing the steps of claim 18.

24. A method of progressively moving a load away from a supporting surface, said method comprising:

providing a plurality of building elements, said building elements being releasably connectable to each other, said building elements having a first mating surface, a second mating surface, and a plurality of non-mating sides, with one of said sides on said elements being completely open and in communication with generally U-shaped openings in said first and second mating surfaces;

releasably connecting a plurality of building elements to each other between the load and the supporting surface thereby assembling an elongate post having an open slot formed on one side along of its length, with a first end of said post bearing against one of said load or said supporting surface;

fixing a lifting device in said open slot in alignment with the major axis of said post and in proximity to the other of said load or said supporting surface and also in proximity to a second end of said post so that said lifting device may be activated to move the load away from the supporting surface;

activating said lifting device to create a sufficient distance between either the load or the supporting surface and said second end of said post to enable the connection of an additional building element to the second end of said post deactivating said lifting device for allowing either said load or said support surface to move into contact with the second end of said post; and repositioning said lifting device within said open slot at a location closer to said second end of said post to enable the lifting device to further move the load away from the supporting surface.

25. The method of claim 24 in which the step of releasably connecting said building elements to each other includes bolting a first or second mating surface on a first building element to a first or second mating surface on a second building element.

26. The method of claim 25 further including the step of providing a shelf member for fixing the location of said lifting device within said open slot at any of a plurality of locations.

* * * * *